US005493104A

United States Patent [19]

Wilson

[11] Patent Number: 5,493,104

[45] Date of Patent: Feb. 20, 1996

[54] METHOD AND APPARATUS FOR AUTOMATICALLY SEPARATING BOXES IN A COUNTER EJECTOR INTO STACKS

[75] Inventor: William J. Wilson, Holland, Pa.

[73] Assignee: The Langston Corporation, Cherry Hill, N.J.

[21] Appl. No.: 109,195

[22] Filed: Aug. 19, 1993

[51] Int. Cl.[6] ..... B61L 1/16; G06M 7/00; B65H 29/34

[52] U.S. Cl. ..... 235/98 R; 271/189

[58] Field of Search ..... 235/98 R, 98 C, 235/98 A, 98 B; 271/189

[56] References Cited

U.S. PATENT DOCUMENTS

| | | | |
|---|---|---|---|
| 2,171,362 | 8/1939 | Gulliksen | 250/41.5 |
| 3,114,902 | 12/1963 | Tanguy | 340/259 |
| 3,150,873 | 9/1964 | MacGregor | 271/57 |
| 3,156,115 | 11/1964 | Adelmann | 235/98 R |
| 3,481,598 | 12/1969 | Lopez | 271/68 |
| 3,587,413 | 6/1971 | Sarka | 93/93 |
| 3,614,088 | 10/1971 | Watson | 271/80 |
| 3,636,828 | 1/1972 | Achelpohl | 93/93 K |
| 3,702,696 | 11/1972 | Teed | 270/66 |
| 3,722,879 | 3/1973 | Johnston et al. | 271/47 |
| 3,752,043 | 8/1973 | Rapparlie et al. | 93/93 DP |
| 4,085,928 | 4/1978 | Sussman | 270/61 R |
| 4,135,616 | 1/1979 | Pellaton | 198/423 |
| 4,159,109 | 6/1979 | Watson et al. | 271/259 |
| 4,200,276 | 4/1980 | Marschke | 271/279 |
| 4,234,179 | 11/1980 | Weir | 493/14 |
| 4,316,607 | 2/1982 | Hayashi et al. | 271/151 |
| 4,436,302 | 3/1984 | Frye et al. | 271/202 |
| 4,485,949 | 12/1984 | Gebhart et al. | 226/2 |
| 4,573,673 | 3/1986 | Haug | 271/111 |
| 4,618,391 | 10/1986 | Torti et al. | 156/353 |
| 4,667,953 | 5/1987 | Hirakawa et al. | 271/280 |
| 4,673,175 | 6/1987 | Morita | 271/10 |
| 4,691,912 | 9/1987 | Gillmann | 271/10 |
| 4,851,075 | 7/1989 | Parker | 156/556 |
| 4,863,154 | 9/1989 | Hirakawa et al. | 271/176 |
| 4,865,309 | 9/1989 | Beasock et al. | 271/227 |
| 4,945,213 | 7/1990 | Didiergeorge | 235/98 R |
| 5,037,365 | 8/1991 | Breton | 493/18 |
| 5,121,915 | 6/1992 | Duncan et al. | 271/111 |
| 5,137,506 | 8/1992 | Haenel et al. | 493/417 |
| 5,201,397 | 4/1993 | Isaacs | 198/395 |
| 5,211,387 | 5/1993 | Lloyd et al. | 271/111 |
| 5,212,656 | 5/1993 | Clary et al. | 364/552 |

FOREIGN PATENT DOCUMENTS

| | | |
|---|---|---|
| 0009528 | 4/1980 | European Pat. Off. . |
| 57-4837 | 1/1982 | Japan . |
| 58-69651 | 4/1983 | Japan . |
| 58-104855 | 6/1983 | Japan . |

OTHER PUBLICATIONS

Igel, J. J., "Document Selection Control Circuit", *IBM Technical Disclosure Bulletin,* vol. 8, No. 5, pp. 725–726 (Oct. 1965).

*Primary Examiner*—Cassandra C. Spyrou
*Attorney, Agent, or Firm*—Seidel, Gonda, Lavorgna & Monaco

[57] ABSTRACT

An apparatus and associated method separates from a stream of boxes a desired number of boxes into a stack of boxes. A conveyor moves the stream of boxes along a path. A speed wheel mounted upstream of the conveyor- or register the speed of the stream of boxes by determining the machine speed. An adjustable backstop is spaced from the conveyor by a length of the boxes in the board path direction for stopping the longitudinal movement of the boxes. A photocell is mounted in association with the conveyor to count the boxes and determine when a trailing edge of the last box passes. It is automatically determined when a leading edge of the box will engage the backstop after the trailing edge passes the photocell. A plurality of fingers are inserted into the stream of boxes by firing a cylinder when the leading edge of the last box engages the backstop therein placing the finger in the stream to temporarily stop the flow of boxes to the stack.

11 Claims, 5 Drawing Sheets

METHOD AND APPARATUS FOR AUTOMATICALLY SEPARATING BOXES IN A COUNTER EJECTOR INTO STACKS

FIELD OF THE INVENTION

This invention is related to the separating of boxes in a stream of boxes into stacks at a counter ejector, and more particularly to an automated process for counting boxes and separating the boxes into stacks by inserting a set of counter ejector fingers into the stream to temporarily hold up the stream of boxes as a previously-formed stack is moved.

BACKGROUND OF THE INVENTION

In the production of corrugated boxes, the corrugated boards produced at a corrugated machine are converted to blanks of a desired shape then folded and glued to form boxes, in a corrugated finishing machine commonly know as a flexo folder gluer. The boxes exit from being folded and glued as a constant stream of boxes. The stream of boxes must be placed in stacks that are manageable for shipping. A counter ejector takes the stream of boxes from the flexo folder gluer and counts and stacks the boxes in to stacks of desired size.

In order to maximize production, the machine is not stopped or even slowed down to allow for separation of the boxes into stacks. Instead, a set of fingers is inserted into the flow of boxes to temporarily support the boxes entering the stacker and separate them from the underlying stack, while the underlying stack is moved. U.S. Pat. No. 3,892,168 discloses a counter ejector having a series of fingers for interrupting the flow of boxes and is incorporated by reference.

The number of boxes delivered in a selected interval is dependent on the size of the box and the complexity of the box, such as number of cut-outs and style of printing. These factors have a bearing on the speed of the machine. Therein because of differences in the production speed, the size of the boxes and in addition the size of the stack desired, the fingers are not consistently inserted at the same time from run to run. The timing for insertion of the fingers must be set properly to separate the stream into stacks. A machine operator may manually adjust the timing of the insertion of the fingers according to the speed the boxes are being produced, however the process of adjusting the timing is trial and error. If the fingers are inserted into the flow of boxes at the improper time, the fingers will not be inserted between boxes but rather hit a box therein causing the boxes to jam.

It is desired to automatically insert the fingers at the correct time to stop the flow of boxes without creating a jam to eliminate operator adjustment of the timing.

SUMMARY OF THE INVENTION

This invention relates to a method and apparatus for separating from a stream of boxes a desired number of boxes into a stack of boxes. A conveyor moves the stream of boxes along a path. A speed wheel mounted upstream of the conveyor register the speed of the stream of boxes by determining the machine speed. An adjustable backstop is spaced from the conveyor by a length of the boxes in the board path direction for stopping the longitudinal movement of the boxes. A photocell is mounted in association with the conveyor to count the boxes and determine when a trailing edge of the last box passes. It is automatically determined when a leading edge of the box will engage the backstop after the trailing edge passes the photocell. A plurality of fingers are inserted into the stream of boxes by firing a cylinder when the leading edge of the last box engages the backstop therein placing the finger in the stream to temporarily stop the flow of boxes to the stack.

Other objects, aspects and advantages of the present invention will be apparent to those skilled in the art upon reading the specification, drawings, and claims which follow.

BRIEF DESCRIPTION OF THE DRAWINGS

For the purpose of illustrating the invention, the drawings are of forms which are presently preferred. However, the invention is not limited to the precise arrangements and instrumentalities shown.

DETAILED DESCRIPTION OF THE INVENTION

Figure 1:
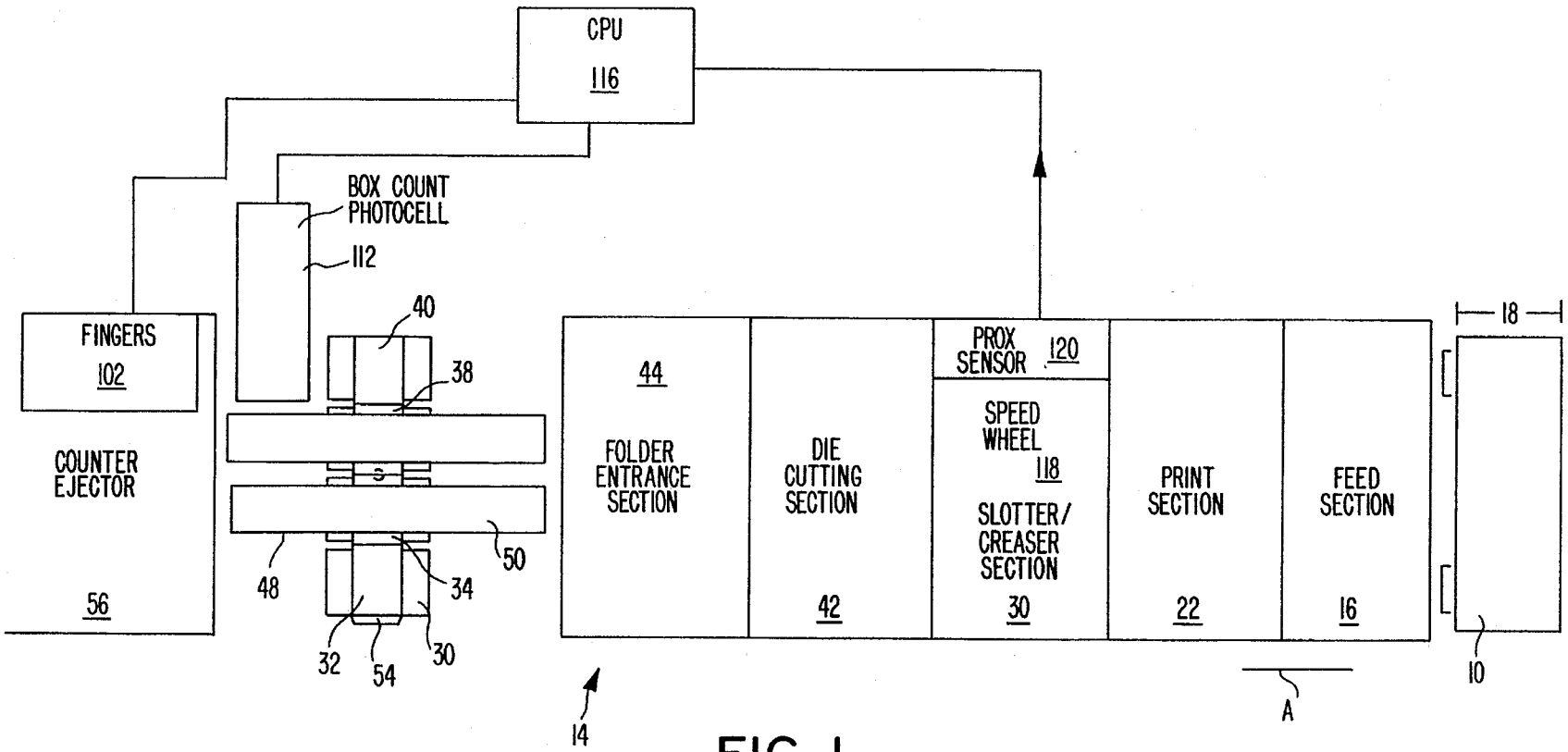
FIG. 1 is a schematic view of a corrugated finishing machine of the preferred embodiment.

In the drawings, like numerals indicate like elements. Referring to the schematic FIG. 1, in the production of boxes, flat rectangular corrugated boards 10 are converted into knock-down, folded glued boxes 12 with appropriate holes and printing using a corrugated finishing machine 14. The corrugated finishing machine 14 consist of several smaller machines or sections that each preform a specific operation.

The corrugated finishing machine 14 has a feed section 16 which receives corrugated boards 10. The feed section 16 takes the boards 10 individually and feeds them in a board path direction "A" (right to left in FIG. 1 ) to the next section. Typically, the stack of boards 10 at the input of the feed section 16 is being continuously replenished such that the corrugated finishing machine 14 is continuously converting corrugated boards 10 into finished boxes 14. The feed section 16 introduces a separation between boards 10, which is dependent on the size of the board and more particularly, to a length 18 of the board 10, measured parallel to the board path direction "A", as will become more apparent below.

After the feed section 16 the next section is a printing section 22, where the board 10 passes between a printing cylinder having a printing die and an impression roller to print indicia (not shown) on the board 10, typically the top surface of the board. It is well known that the board 10 is moved through the print section and the following two sections by engaging cylinders and moving at the rate of the cylinders, therein the cylinders surface tangential velocity is identical to the board speed, and is commonly referred to as machine speed. In addition, there are typically pull rolls and pull collars which assist in moving the board 10 along the path. In order for the print cylinder and other cylinders described below to preform their designated operation on the board 10 at the desired location, each individual board 10 must engage the cylinders in an identical position as the other boards 10 (i.e., the same portion of the cylinder registers with the same portion of the board 10). With the requirement to maintain registration between the board, and the cylinders that operate on the board 10, the cylinders typically have identical circumferences, which is called the machine size or machine pitch. The separation between boards is therefore dependent on the board length 18 and machine pitch in order that the registration is properly maintained.

The next section of the corrugated finishing machine 14 is a slotting scoring section 26 also called the slotter creaser section. The slotting scoring section 26, similar to the printing section, has a pair of cylinders through which the board 10 passes. The cylinders have dies which score and/or slit the board 10 parallel to the board path direction "A". The slotting scoring section 26 converts the board 10 into a blank 30 having four panels 32, 34, 38 and 40. The creases which run perpendicular to the board path direction "A" and need to form the flaps are placed on the board 10 prior to the corrugated finishing machine 14 or in the section after the slotting scoring section 26. The four panels are connected to each other in a direction perpendicular to the board path direction "A" and comprise two outer panels 32 and 40 and two inner panels 34 and 38. The corrugated board 10 is called a blank 30 after leaving the slotting scoring section 26.

The final section that uses a pair of cylinders through which the board 10 (now a blank 30) passes is a die cutting section 42. The die cutting section 42 has a cutting cylinder with a series of dies and an anvil cylinder. The die cutting section 42 makes holes and irregular cuts in the blank and is capable of placing the creases on the board 30 perpendicular to the board path to form the flaps. While the die cutting section 42 can make more difficult cuts than the slotting scoring section 26, the use of a die cutting section typically slows down the production rate and is therefore not used unless required.

A folder gluer section 44 follows the die cutting section 42 and transforms a flat scored and slotted blank 30 into a folded glued box 12. The folder gluer 44 includes a conveyor 48 having a pair of vacuum belts 50 which engage the upper surface of the inner panels 34 and 38 of the board 10 for holding the board 10 in proper position. The conveyor 48 of the folder gluer 44 also has a series of rods and a pair of belts 52 (see FIG. 2) for folding the outer panels 32 and 40 down and under the inner panels 34 and 38. A glue applicator at the entrance to the folder gluer section 44 applies glue to a glue tab 54 located outboard of one of the outer panels, such as panel 32. When the folder gluer 44 has converted the flat blank 30 into the folded glued box 12, the box 12 is sandwiched between the upper vacuum belts 50 and the lower belts 52 of conveyor 48. Typically the folder gluer section 44, in addition to moving the box longitudinally away from the die cutting section 42 and towards a counter ejector section 56, also raises the box vertically to facilitate the stacking of the boxes 46 in the counter ejector section 56.

Figure 2:
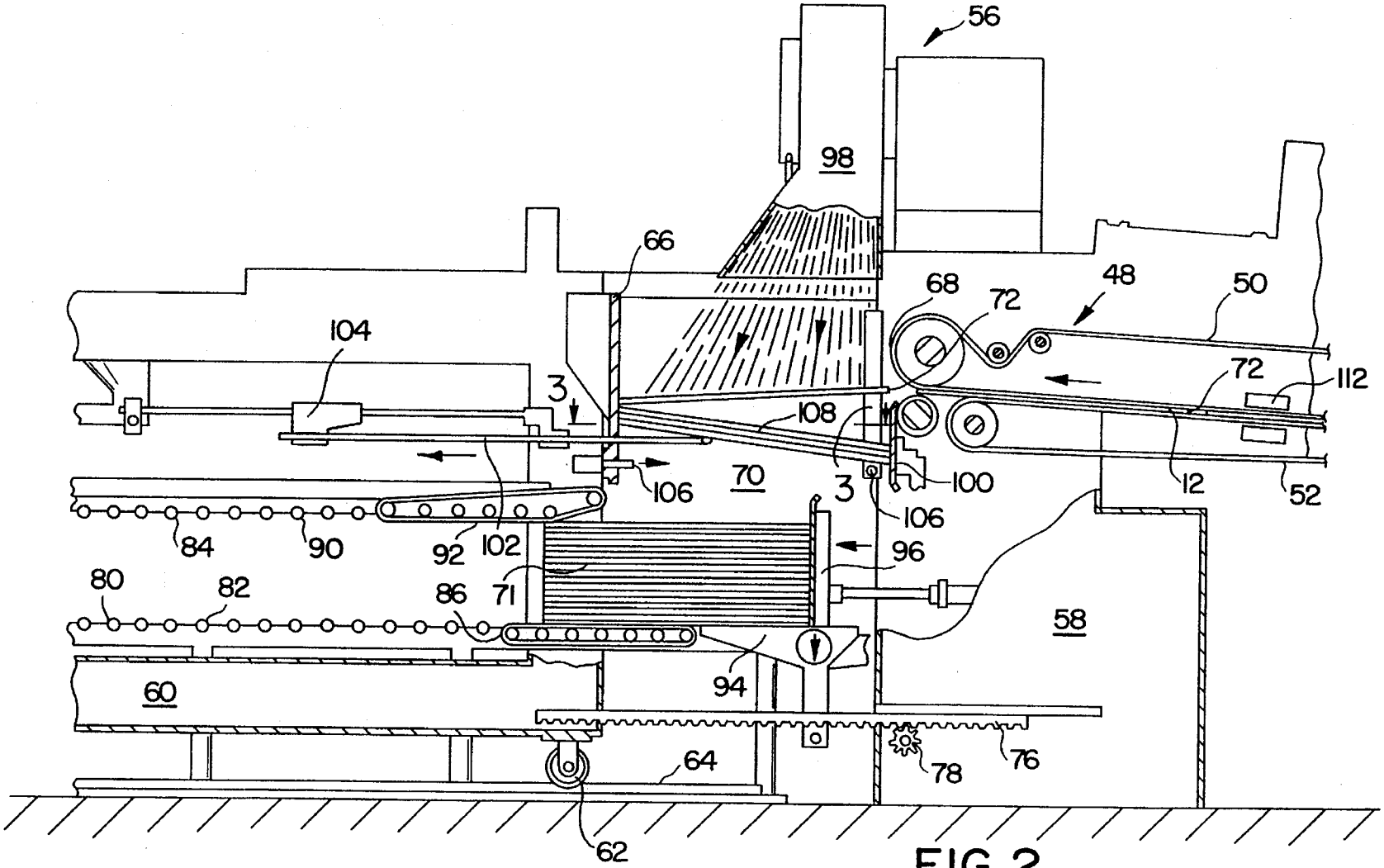
FIG. 2 is a side elevation view of a counter ejector of the corrugated finishing machine of the preferred embodiment.

Referring to FIG. 2, the counter ejector 56 has a fixed frame 58 located downstream of the folder gluer section 44 (not shown in FIG. 2). Boxes 12 are conveyed to the counter ejector 56 by conveyor 48 in a constant stream. Alternatively, the counter ejector 56 can have its own conveyor for receiving boxes from conveyor 48.

The counter ejector has a movable frame 60 with wheels 62 that travel on rails 64 so that a backstop 66 may be positioned a selected set distance relative to the fixed frame 58 and the conveyor 48. The movable frame 60 has a rack 76 which engages a rotating pinion 78 located on the fixed frame 58 for positioning the movable frame 60 relative to the fixed frame 58. The set distance is measure from an end 68 of the upper conveyor belt 50 and is dependent on the box length 18 in board direction "A". The set distance is equal to the box length 18, such that as the trailing edge 72 of a box 12 enters a space 70, the leading edge 74 of the box 12 hits the backstop 66. The backstop 66, the conveyor 48, and the fixed frame 58 define the space 70 where the boxes 12 drop to form a stack 71.

A second conveyor system 80 for moving the stacks 71 consist of a lower conveyor 82 and an upper conveyor 84. The lower conveyor 82, which is fixed relative to the fixed frame 58, has a series of belt driven rollers 86 for moving the stack 71. The upper conveyor 84, which moves with the movable frame 60, has a plurality of idler rollers 90 except the portion in close proximity to the backstop 66 where it has a roller driven belt 92.

The fixed frame 58 has an elevator 94 which moves up and down to receive the boxes 12 which drop from the conveyor 48. A pusher 96 located on the fixed frame 58 transfers the stack 71 of boxes from the elevator 94 onto the second conveyor 80. In addition, the fixed frame 58 has an air blower 98 for pushing the boxes 12 downward onto the elevator 94 and into a slightly compressed position.

A spanker 100, located on the fixed frame 58 just below the conveyor 48, moves reciprocally toward and away from the stack and engages the trailing edges 72 of boxes 12 in stack 71 and cause the opposite edges, leading edges 74, of the boxes 12 in stack 71 to contact the backstop 66 to align the boxes 12 and square up the stack.

Figure 3:
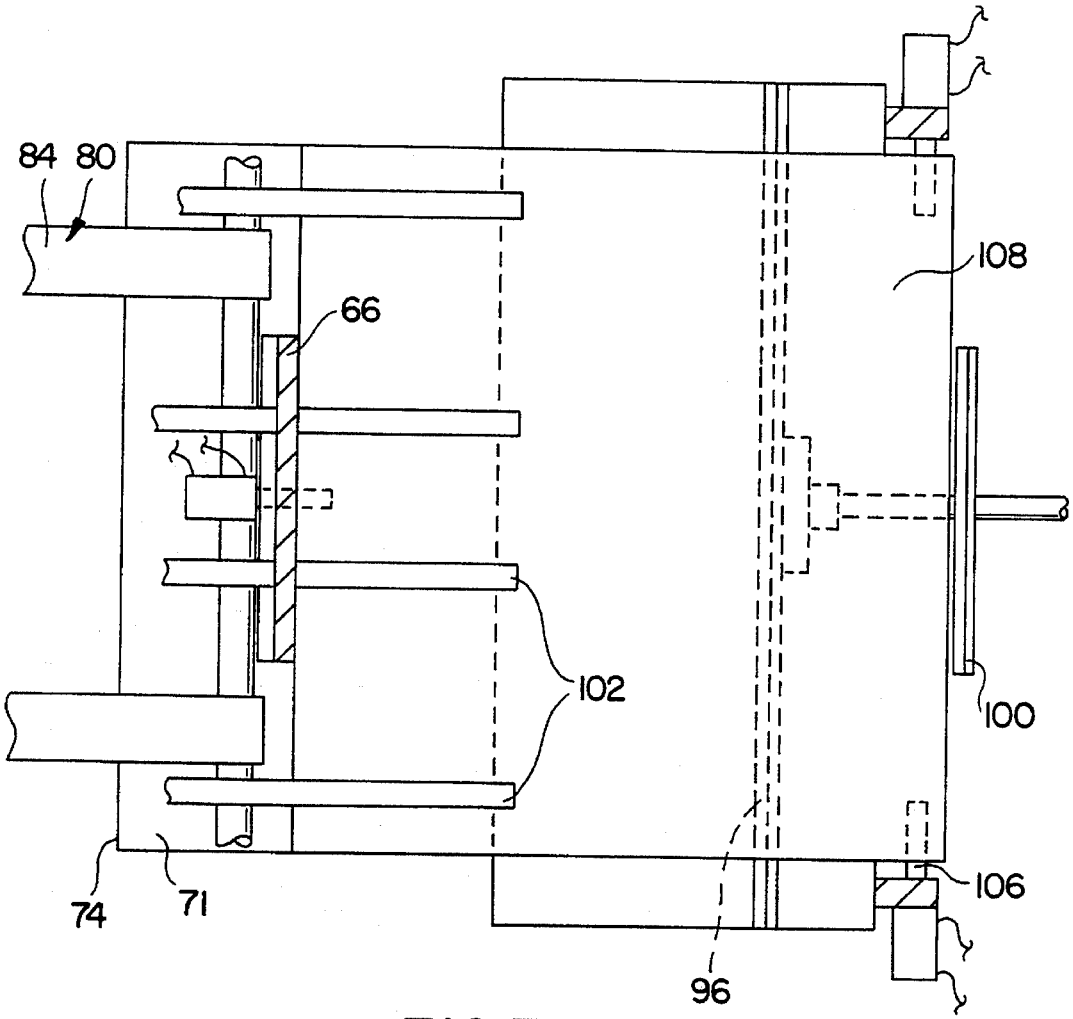
FIG. 3 is a cross-sectional view of a portion of the counter ejector taken along line 3—3 in FIG. 2.

In order to separate the boxes 12 into stacks 71 and prohibit more boxes 12 from dropping as the pusher 96 transfers the stack 71 of boxes 12 off the elevator 94 onto the conveyor 80, the counter ejector 56 has a plurality of fingers 102 (as best seen in FIG. 3) which project into the space 70 to temporarily stop the boxes 12 from dropping onto the elevator 94. The fingers 102 are extended into the stream by a solenoid driven cylinder 104. A second set of fingers 106 is below the first set of fingers 102. The second set of fingers 106 are below the first set of fingers 102 so that the boxes 12 drop onto the second set of fingers 106 when the first set of fingers 102 are withdrawn, but not below to elevator 94 and pusher 96, until the elevator 94 and pusher 96 are back in proper position. At that time, the second set of fingers 106 is retracted to a drop position and a stack 108 that has began to form above the fingers 106 to drop to the elevator 94.

The invention comprises placing a diffused retro-reflective sensor or photo cell 112, precisely one machine pitch from the end 68 of the conveyor 48 and the entrance to the space 70 (See FIG. 2). The photo cell 112 determines when the trailing edge 72 of a box 12 has passed. The photo cell 112 sends this information to a CPU 116 (represented schematically in FIG. 1). Upstream at the slotting scoring section 26 is a speed wheel 118 associated with one of the cylinders that engages the board 10. The speed wheel 118 rotates with the cylinder at the machine speed. The speed wheel 118 has a plurality notches and teeth around its circumference. As the speed wheel rotates with the cylinder at the machine speed (i.e., the revolutions per minute RPM), a proximity imity sensor 120 mounted in the slotting scoring section 26 will switch on and off as it reads the teeth and notches of the speed wheel 118. The proximity sensor 120 can be any of a variety of sensors well known in the industry, including but not limited to a magnetic sensor, a hall effect sensor, or a photo-optic sensor. The speed wheel 118 design is tailored to that of the proximity sensor 120. The switching on and off of the proximity sensor 120 is in proportion to the machine speed and the speed of the boards 10. The series of pulse whose frequency is proportional to the machine speed from the proximity sensor 120 is fed to the CPU 116.

Figure 4:
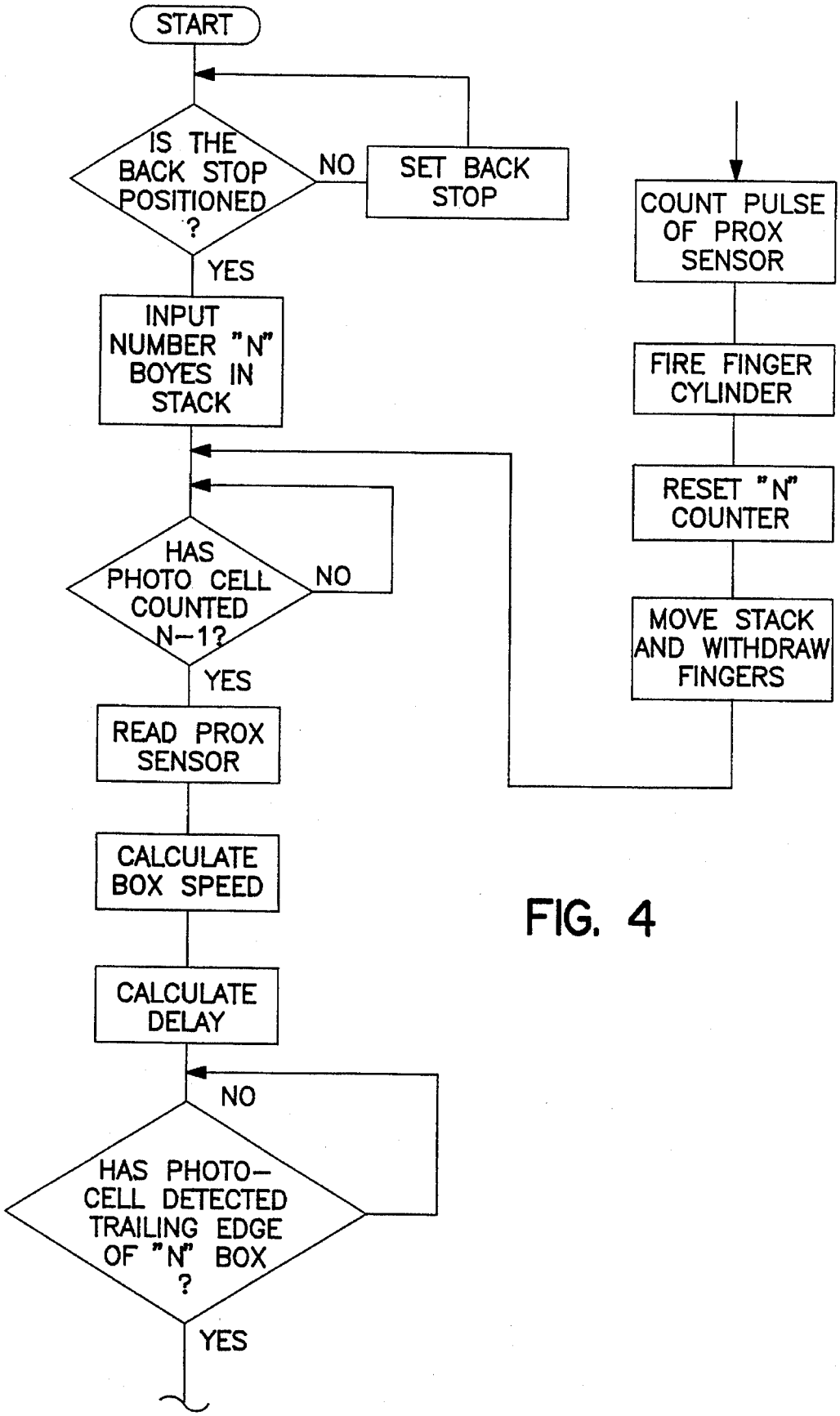
FIG. 4 shows a flow diagram of the method for determining the proper time for insertion of the fingers in accordance with the present invention.

Referring to FIG. 4 which is a flow diagram of the method for determining the proper time for insertion of the fingers, when the corrugated finishing machine 14 is turned on, the size of the board 10 is entered either manually or directly from adjustments made at the feed section 16 into the CPU 116 of the corrugated finishing machine 114. The movable frame 60 with the backstop 66 is positioned so that the distance between the backstop 66 and the end 68 of the conveyor 48 is equal to the box length 18. The photocell 112 is therefore one machine pitch plus one box length 18 from the backstop 66.

The numbers of boxes desired in a stack 71 is manually inputted or otherwise the default number is selected by the CPU 116. The photocell 112 provides a signal to the CPU 116 each time the trailing edge 72 of a box 12 passes, and the CPU 116 counts the boxes 12 and determines when the number of boxes 12 in the stack 71 is one less than the desired (preselected) number for the stack 71.

The proximity sensor 120 is constantly sending to the CPU 116 a series of pulses proportional to the machine speed. When the CPU 116 determines that one less than the desired number of boxes has passed the photocell 112, the CPU 116 calculates how long it will take for the leading edge 74 of the next (and last) box for the stack to hit the backstop 66 after its trailing edge 72 passes the photocell 112.

With the photocell 112 spaced exactly one machine pitch plus one box length from the backstop 66, the leading edge 74 of the box 12 is exactly one machine pitch from the backstop 66 when the trailing edge 72 passes the photocell 112. After the CPU 116 determines how long it will take for the leading edge 74 of the last box to hit the backstop 66, the CPU 116 calculates how many pulses from the proximity sensor 120 after the trailing edge 72 of the box 12 passes the photocell 112 until it is time to fire the solenoid driven cylinder 104.

Figure 5:
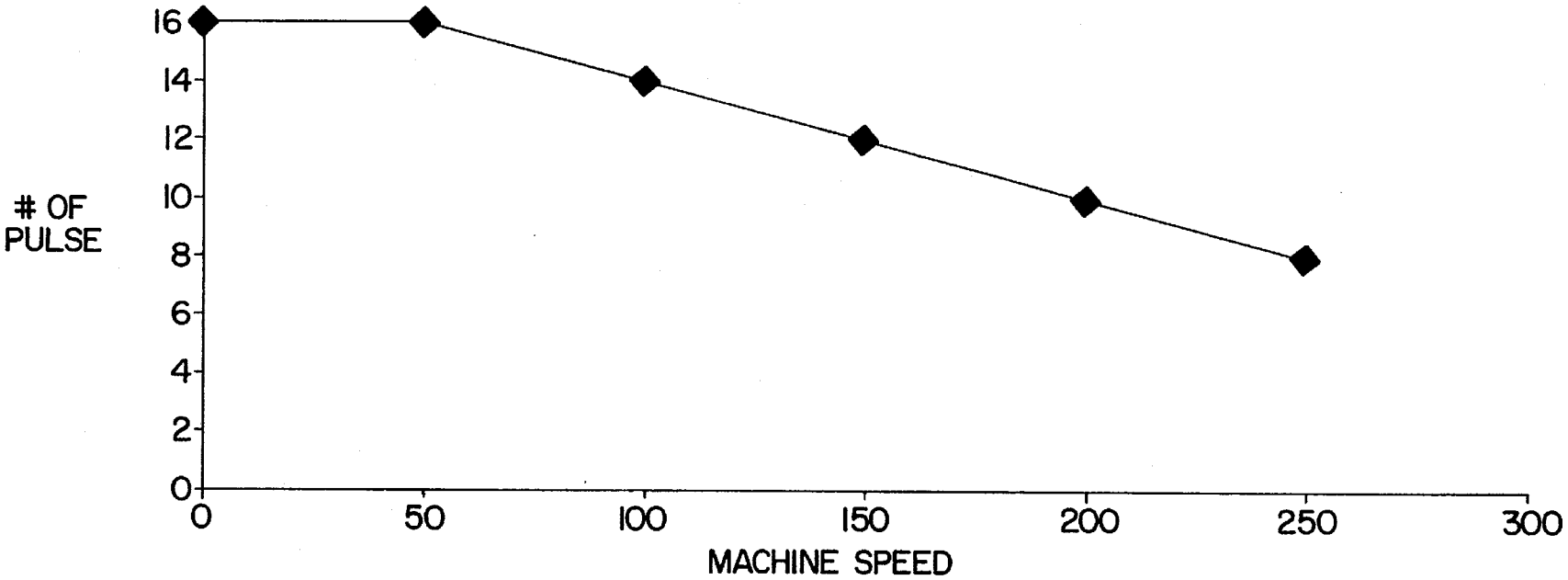
FIG. 5 is a graph shows an example of pulses to triggering the fingers versus machine speed.

At a slower machine speed, the time the leading edge 74 of the box 12 takes to reach the backstop 66 after the trailing edge 72 passes the photocell 112 is longer. The rate of pulses from the proximity sensor 120 decreases as the machine slows, therefore a linear relationship does not exist between machine speed and the number of pulses occurring until firing the solenoid driven cylinder 104. FIG. 5 shows a graph of an example of pulses to triggering the fingers versus machine speed. When the machine speed is below a certain speed (below 50 in the example in FIG. 5), the timing of the insertion of the fingers is not as critical and the number of pulses is held at a constant.

When the fingers 102 are extended, the boxes coming from the conveyor 48 are temporarily supported above the elevator 94, and the elevator 94 is then free to descend. After the elevator has descended, the pusher 96 then transfers the stack 71 onto the second conveyor 80. As the elevator 94 and pusher 96 are moving the stack 71 to the second conveyor 80, the second set of fingers 106 extend to the engaging position and the first set of fingers 102 retract to the drop position such that the boxes 12 supported by the first set of tingers 102 drop to the second set of fingers 106. The first conveyor 48 continues to feed boxes from the folder gluer section 44 into space 70 with the photocell 112 and the CPU 116 maintaining count of the boxes above the fingers 106.

When the elevator 94 is raised and pusher 96 is retracted and ready to receive more boxes 12, the second set of fingers 106 are retracted and the beginning of the next stack 108, which has formed on the fingers 102 and 106, drops to the elevator 94 with assistance of the blower 98. The CPU 116 continues to count and the first set of fingers 102 are inserted when the desired number has been reached again.

It is evident from the foregoing that various modifications, which are apparent to those skilled in the art, can be made to the embodiments of this invention without departing from the spirit or scope thereof.

I claim:

1. An apparatus for separating a sequence of articles being conveyed along a path into successive groups of a preselected number of articles, comprising:

a speed sensor for sensing a speed at which the articles are being conveyed;

an article counter for counting individual articles arriving at a selected location;

an article sensor for determining when a trailing edge of each of said articles passes a first selected point along the path;

a processor responsive to the speed sensor, the article counter, and the article sensor for making a determination (i) when the trailing edge of the last of the preselected number of articles has passed the first selected point and (ii) when a leading edge of the last of the preselected number of articles is expected to reach a second selected point along the path, and for outputting a control signal in response to the determination; and a separator responsive to the control signal for interrupting the sequence after the last of the preselected number of articles has reached the second selected point.

2. An apparatus for separating a sequence of articles conveyed along a path as in claim 1 wherein a photocell functions as both the article counter and the article sensor.

3. An apparatus as in claim 1 wherein the second selected point is determined by the size of the articles.

4. An apparatus for separating from a stream of boxes a preselected number of boxes into a stack of boxes, the boxes each having a leading edge and a trailing edge spaced by a specific longitudinal length, the apparatus comprising:

a conveyor for transporting the stream of boxes in a longitudinal direction;

stop means spaced longitudinally from the conveyor the specific longitudinal length of the boxes;

means for determining the speed of the boxes on the conveyor;

means for counting individual boxes and determining when the trailing edge of the box is at a selected location;

a processor responsive to the speed determining means, the counting and trailing edge determining means for making a determination (i) when the trailing edge of the last of the preselected number of boxes has passed the selected location, and (ii) when the leading edge of the last of the preselected number of boxes is expected to reach the stop means, and for outputting a control signal in response to the determination; and a separator responsive to the control signal for interrupting the sequence after the last of the preselected number of boxes has reached the stop means.

5. An apparatus as in claim 4 wherein the stop means is an adjustable backstop spaced from the conveyor by the longitudinal length of the boxes for stopping the longitudinal movement of the boxes.

6. An apparatus as in claim 5 wherein the means for determining when the trailing edge of the box is at a selected location is a photocell mounted in association with the conveyor.

7. An apparatus as in claim 6 further comprising a cylinder upstream of the conveyor for moving the stream of boxes and having a circumference defined as a machine pitch.

8. An apparatus as in claim 7 wherein the photocell is mounted upstream of the end of the conveyor by the machine pitch.

9. An apparatus as in claim 6 wherein the separator is a plurality of fingers.

10. An apparatus as in claim 4 wherein the means for determining the speed of the boxes is a speed wheel for measuring the speed of a drive cylinder.

11. An apparatus as in claim 10 wherein the speed wheel is mounted upstream of the conveyor.

* * * * *